United States Patent [19]

Hamilton

[11] Patent Number: 4,585,039

[45] Date of Patent: Apr. 29, 1986

[54] GAS-COMPRESSING SYSTEM

[76] Inventor: Richard A. Hamilton, 17203 SE. Cougar Mountain Dr., Issaquah, Wash. 98027

[21] Appl. No.: 576,190

[22] Filed: Feb. 2, 1984

[51] Int. Cl.[4] ..... B65B 31/00

[52] U.S. Cl. ..... 141/47; 141/4; 141/54; 417/364; 60/593

[58] Field of Search ..... 141/4, 11, 12, 37, 39, 141/49, 52, 54, 71, 311, 192, 198, 3; 417/254, 263, 53, 364; 60/593

[56] References Cited

U.S. PATENT DOCUMENTS

| | | | |
|---|---|---|---|
| 2,979,903 | 4/1961 | Beck | 60/593 X |
| 3,282,305 | 11/1966 | Antolak | 141/45 X |
| 4,051,877 | 10/1977 | Fletcher et al. | 141/4 |
| 4,308,001 | 12/1981 | Hofbauer et al. | 417/364 |
| 4,351,153 | 9/1982 | Kosmala | 60/593 X |

*Primary Examiner*—Stephen Marcus
*Assistant Examiner*—Ernest G. Cusick
*Attorney, Agent, or Firm*—Ward Brown; Robert W. Beach

[57] ABSTRACT

Combustible fuel gas at low or moderate pressure is supplied to an inlet in the top of an upright working cylinder. The working cylinder then is filled with liquid through a bottom liquid inlet to force the gas from the cylinder and direct it into a storage cylinder. A check valve prevents backflow of gas from the storage cylinder as the liquid is drained from the working cylinder and as the working cylinder again is filled with low or moderate pressure gas. The process of filling the working cylinder with liquid to force the gas from it into the storage cylinder and holding the gas in the storage cylinder while the liquid is drained and the working cylinder is refilled with gas is repeated until the gas in the storage cylinder is a desired high pressure, such as 1500 psi or higher. Two working cylinders can be provided so that, as one of them is drained, the other is filled with liquid, such that gas is substantially continuously forced into the storage cylinder until the desired high pressure is achieved.

12 Claims, 4 Drawing Figures

GAS-COMPRESSING SYSTEM

BACKGROUND OF THE INVENTION

1. Field of the Invention

The present invention relates to a system for compressing gas, particularly combustible fuel gas.

2. Prior Art

With the increasing expense and scarcity of liquid fuels, more effort is being concentrated on developing use of less expensive and more readily available gas fuels. For example, vehicles have been modified to run on natural gas or propane.

Gas fuels, of course, occupy a large volume unless they are stored at high pressure. In the example of modified vehicles, even when large bulky fuel tanks are provided the vehicles usually have limited ranges. If gas fuels could be compressed economically and stored at higher pressures, the popularity of the modified vehicles almost certainly would increase because of the increased ranges of the vehicles.

There are problems in compressing gas fuels to high pressures with conventional, mechanically driven, gas-compressing equipment. The gas fuels tend to promote corrosion and wear and, particularly at higher pressures such as 1500 psi or higher, all but the most durable materials used for cylinders, mechanically-driven pistons, valves, seals, and so on, tend to wear quickly. Consequently, conventional equipment capable of compressing gas fuels to high pressure is expensive to manufacture and maintain.

In addition, as components of the conventional gas-compressing equipment become worn, there is an increased risk of air leaking into the compression chambers. Compressing the air heats it, increasing the risk of an explosion or fire.

SUMMARY OF THE INVENTION

The principal object of the present invention is to provide a simple, inexpensive, safe system for compressing gas, particularly combustible fuel gas, to high pressure such as 1500 psi or higher.

In the preferred embodiment of the present invention, such object is accomplished by supplying gas at low or moderate pressure through an inlet in the top of an upright working cylinder, followed by pumping liquid into the working cylinder through a bottom liquid inlet to force such gas from such cylinder, directing the gas forced from the working cylinder into a storage tank or cylinder, and preventing backflow of gas from the storage cylinder while the liquid is drained from the working cylinder. The process is repeated until the pressure of gas in the storage cylinder is the desired high pressure, such as 1500 psi or higher.

Preferably the gas supplied to the working cylinder is low pressure gas which, prior to introduction into the working cylinder, is fed to an upright accumulator. An outlet from the upper portion of the accumulator feeds the gas to a conventional, moderate pressure compressor driven by an internal combustion engine. The engine is driven by gas supplied from the bottom portion of the accumulator.

In the preferred embodiment two working cylinders are provided, such cylinders being alternately supplied with liquid through their bottom liquid inlets so that, as liquid is drained from one cylinder, liquid is supplied to the other, as directed by an automatic control system including pressure switches, relays and variable position valves. The control system also senses the pressure of gas in the storage cylinder and automatically stops the gas-compressing process when the desired pressure has been reached.

The working cylinders and the storage tank include internal floats preventing any substantial mixing of gas in the upper portion of the cylinders with liquid in the lower portions of the cylinders. Each float carries valve mechanism for seating in the upper gas inlet when the corresponding cylinder is filled with liquid and for seating in the bottom liquid inlet when such cylinder has the liquid drained from it.

A portable tank can be filled with gas from the storage cylinder by connecting the portable tank in parallel to the storage cylinder. Liquid can be pumped through a bottom liquid inlet of the storage tank for forcing gas from the storage tank into the portable tank.

DETAILED DESCRIPTION

General Description

A gas-compressing system in accordance with the present invention can be used to compress a combustible fuel gas to high pressure, to store the compressed fuel gas in a storage tank or cylinder, to allow quick transfer of the compressed fuel gas to a portable tank, such as a vehicle fuel tank, and to compress additional fuel gas automatically for storage in the storage cylinder or for direct transfer to the portable tank.

Figures 1, 2:
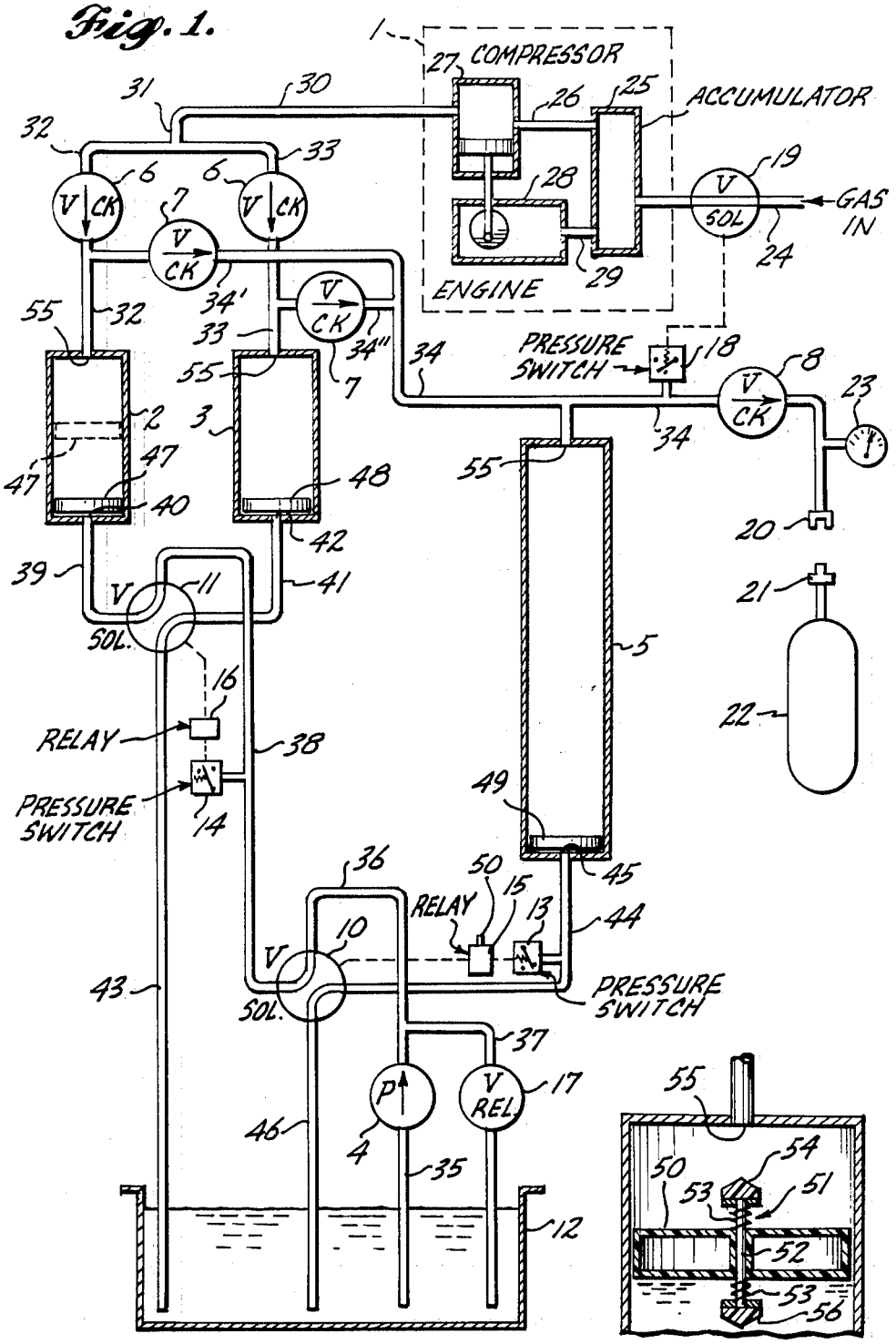
FIG. 1 is a block, hydraulic circuit diagram of a gas-compressing system in accordance with the present invention.
FIG. 2 is a fragmentary, axial section through one component of the system shown in FIG. 1.

As shown in FIG. 1, in the preferred embodiment of the invention the main components of the system are: a moderate pressure gas-supplying component 1; upright working cylinders 2 and 3 receiving gas from the gas-supplying component; a conventional hydraulic pump 4 for supplying hydraulic liquid alternately to the working cylinders 2 and 3, respectively, so as to force the gas supplied to such cylinders out of them; and a larger, upright storage tank or cylinder 5 receiving the gas forced from the working cylinders.

Check valves 6, 7 and 8 control the direction of the flow of gas supplied by the gas-supplying component 1.

Variable position valves 10 and 11 control the flow of hydraulic liquid from a reservoir 12 to the working cylinders 2 and 3 and the storage cylinder 5, and from such cylinders back to the reservoir. Such variable position valves are controlled by pressure-responsive switches 13 and 14 actuating relays 15 and 16. In the event of a malfunction such that the pressure of hydraulic liquid in the system increases to a dangerous level, a relief valve 17 drains hydraulic liquid pumped by the pump 4 back to the reservoir 12.

Another pressure-responsive switch 18 senses the pressure of the fuel gas in the system and automatically closes a valve 19 controlling supply of gas to the gas-supplying component when a desired pressure is reached. An outlet connection 20 is provided for quick coupling to a mating connection 21 of a portable tank 22, such as a vehicle fuel tank, allowing transfer of gas from the storage cylinder 5 to the portable tank. A pressure gauge 23 indicates the pressure of the gas in the portable tank when it is connected to the gas-compressing system.

Gas Flow

In the preferred embodiment, the fuel gas is fed at low pressure to the gas-supplying component 1 through an inlet conduit 24 having the primary gas supply valve 19 to the inlet of an upright accumulator 25. An outlet conduit 26 from the upper portion of such accumulator feeds the gas to a conventional, moderate pressure, mechanical compressor 27 driven by an internal combustion engine 28 modified to run on the fuel gas. Another outlet conduit 29 from the bottom portion of the accumulator supplies the fuel gas for running the engine.

In a representative installation, the fuel gas is natural gas supplied from a gas main at a pressure of about 0.4 psi above atmospheric pressure; and the compressor 27 increases the pressure of the fuel gas to about 200 psi.

Should a leak occur upstream of the engine such that a mixture of air and gas is introduced into the accumulator, the gas, being lighter than the air, will rise to the top of the accumulator so that substantially pure gas is supplied to the compressor 27, whereas the air will pass through the bottom outlet conduit 29 to the engine, automatically starving the engine of fuel and stopping it. In addition, if there is a surge in pressure in the gas main the air-fuel mixture supplied to the engine will be too rich which also results in the engine stopping. This prevents the gas from being compressed to a dangerous pressure due to the pressure at the inlet of the compressor being substantially higher than the design conditions.

The compressor discharges the moderately compressed gas through an outlet conduit 30 and a tee 31 which branches to inlet conduits 32 and 33 which supply the gas to the upper portions of the working cylinders 2 and 3, respectively. Check valves 6 in the inlet conduits 32 and 33 prevent backflow of gas from the working cylinders to the engine-driven compressor.

An inlet conduit 34 for supplying gas to the upper inlet of the upright storage cylinder 5 has branches 34' and 34'' communicating with the working cylinder inlet conduits 32 and 33. Such branches 34' and 34'' have check valves 7, each check valve being interposed between one of the working cylinder inlet conduits and the storage cylinder inlet to prevent backflow of gas from the storage cylinder to the working cylinders, or flow of gas between the working cylinders. Conduit 34 also serves as the outlet conduit from the storage cylinder to the quick coupling connection 20, with check valve 8 preventing backflow of gas into the storage cylinder.

In summary, there is a continuous supply of low-pressure gas to the gas-supplying component 1 and a continuous supply of moderate pressure gas from such gas-supplying component to the working cylinders and to the storage cylinder.

Hydraulic Liquid Flow

A pump inlet conduit 35 feeds hydraulic liquid from the reservoir 12 to the conventional hydraulic pump 4 which discharges the liquid through a pump outlet conduit 36 to the variable position solenoid valve 10. A conduit 37 having the pressure-relief valve 17 branches from the pump outlet conduit 36 and discharges hydraulic liquid pumped by the pump 4 back to the reservoir 12 if a predetermined pressure is exceeded, such as 2500 psi in a representative installation.

Usually valve 10 is in the position shown in FIG. 1 in which hydraulic liquid supplied through the outlet conduit 36 flows through such valve and a working cylinder supply conduit 38 to the other variable position solenoid valve 11. When in the position shown in FIG. 1, valve 11 supplies the hydraulic liquid through the liquid conduit 39 for the working cylinder 2 to its bottom liquid inlet 40. In a second position of the valve 11, shown in FIG. 3, liquid from the pump supplied through conduit 38 is fed through a liquid conduit 41 to the bottom liquid inlet 42 for the other working cylinder 3.

As seen in FIG. 1, if valve 11 is in position to supply hydraulic liquid to the first working cylinder 2, any liquid in working cylinder 3 is drained through the valve to the reservoir 12 by another conduit 43. Similarly, if valve 11 is in the position shown in FIG. 3 for supplying hydraulic liquid to the second working cylinder 3, any liquid in the first cylinder 2 is drained to the reservoir through the conduit 43.

Figure 3:
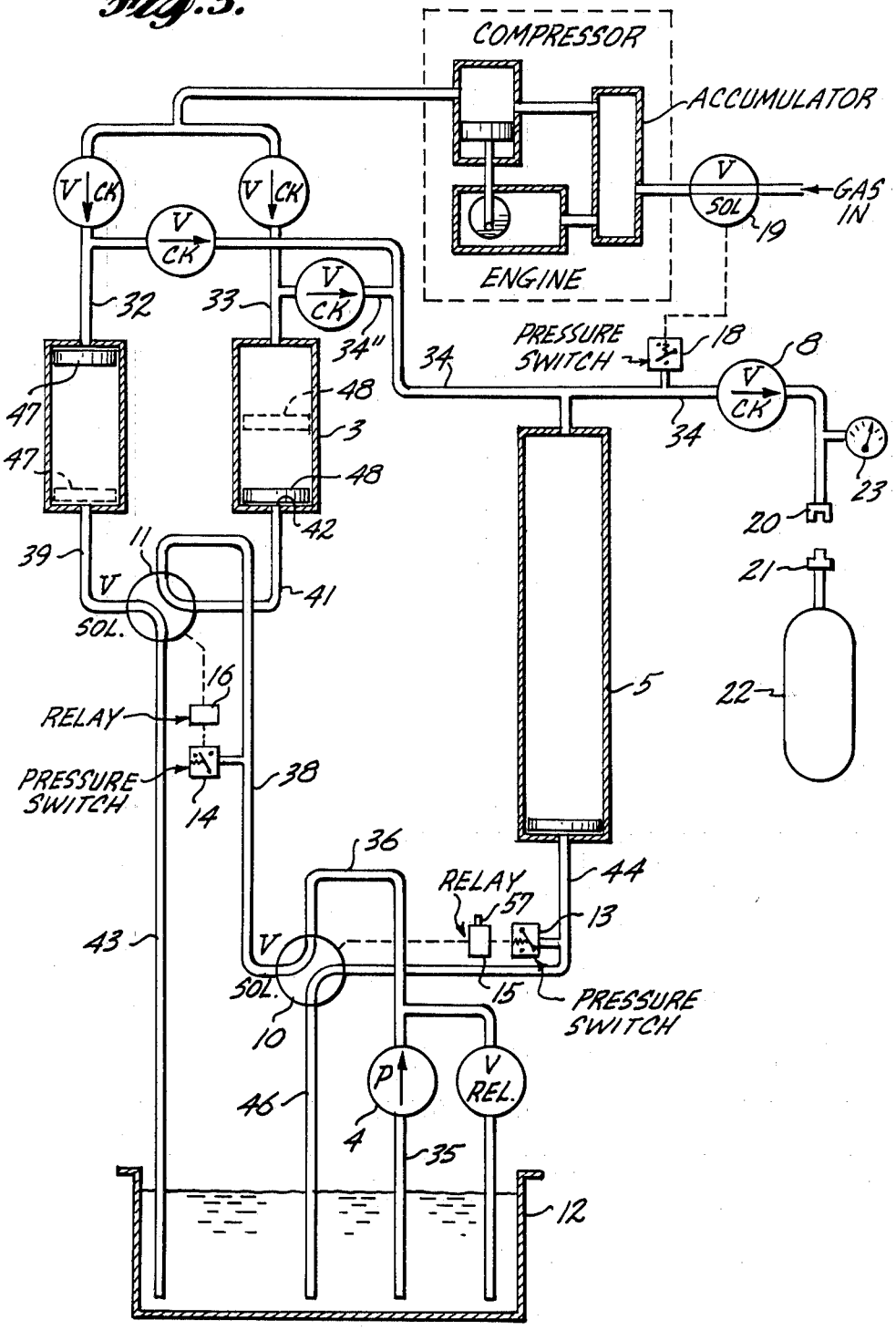
FIGS. 3 and 4 are block, hydraulic circuit diagrams corresponding to FIG. 1 but illustrating components of the gas-compressing system in different operating conditions.
Figure 4:
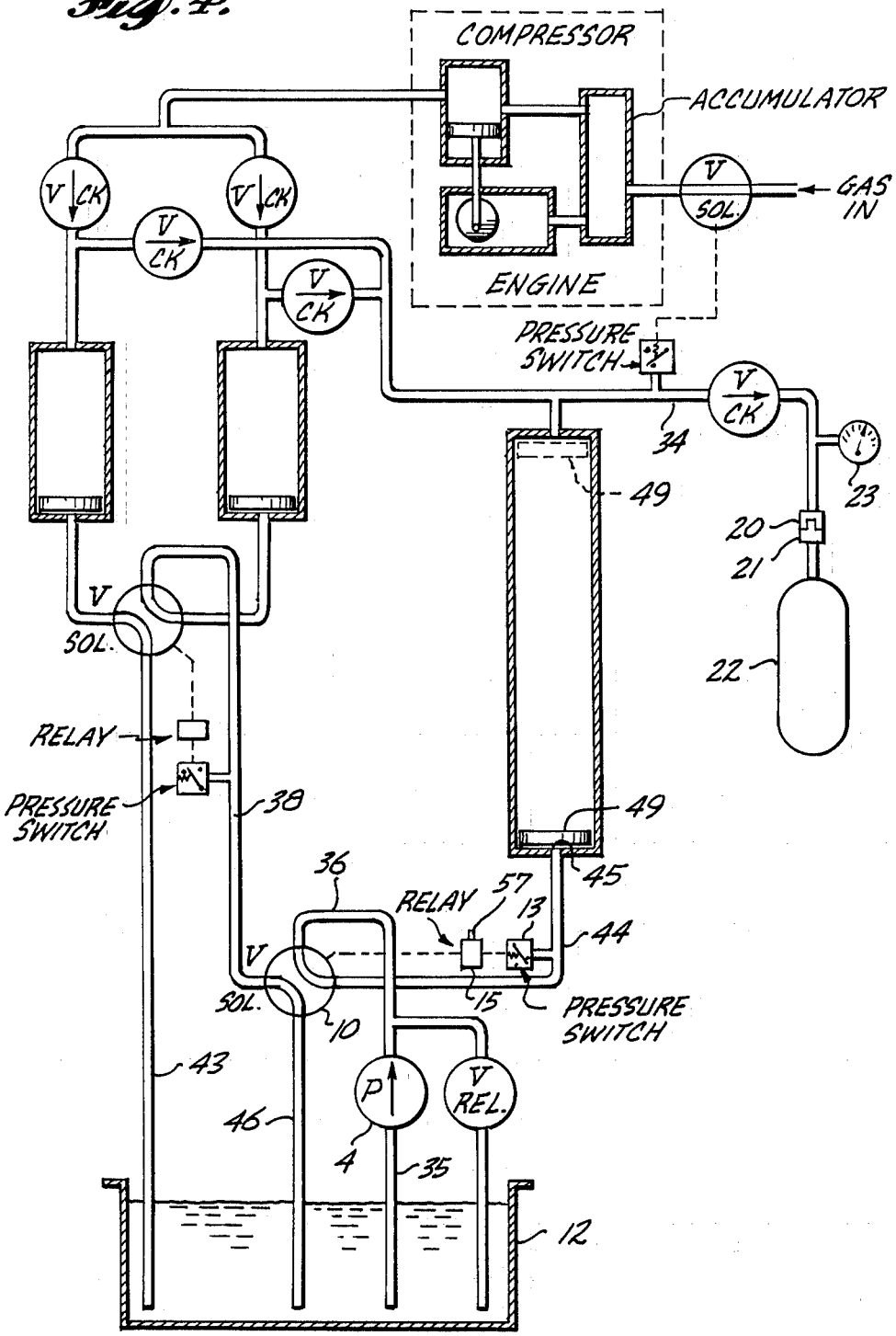

In a second position for the valve 10, shown in FIG. 4, hydraulic liquid from the pump 4 is supplied through a liquid conduit 44 to the bottom liquid inlet 45 of the upright storage cylinder 5, while the working cylinder supply conduit 38 is connected to a discharge conduit 46 such that the two conduits 43 and 46 drain all hydraulic liquid from both working cylinders to the reservoir. In the primary or normal position of the valve 10, shown in FIGS. 1 and 3, the liquid conduit 44 for the storage cylinder 5 is connected to the conduit 46 for draining any hydraulic liquid in the storage cylinder to the reservoir.

Working Cylinder and Storage Tank Construction

With reference to FIG. 1, the working cylinders 2 and 3 and the storage cylinder 5 have internal floats 47, 48 and 49, respectively, of the general construction shown in FIG. 2. Preferably, each float includes a buoyant body portion 50 loosely fitted in its cylinder but, nevertheless, of the same cross-sectional shape as its cylinder and substantially filling the space encircled by the upright wall of such cylinder. Each float moves up and down with the level of hydraulic liquid in its cylinder and prevents any substantial mixing of gas above the float with hydraulic liquid below the float.

Each float also has a central valve mechanism 51, shown diagrammatically in FIG. 2, including an upright axial shaft 52 biased to a vertically centered position by upper and lower helical compression springs 53. A tapered upper resilient valve portion 54 carried at the top of the upright shaft 52 seats in the top gas inlet 55 when the level of liquid in the cylinder raises the float body to the top of the cylinder. A tapered lower valve portion 56 seats in the bottom liquid inlet 40, 42 or 45 when the liquid in the cylinder is drained to the reservoir. The floats prevent any flow of hydraulic liquid out the gas inlet of the cylinders and any flow of gas out the liquid inlets of the cylinders.

Operation

The "start-up" positions for the valves 10, 11 and 19 are shown in FIG. 1. Initially, the working cylinders 2 and 3 and the storage cylinder 5 are filled with gas at the moderate pressure determined by the gas-supplying component 1, such as about 200 psi. Hydraulic liquid pumped through conduits 36 and 38 to the inlet conduit 39 for the working cylinder 2 raise the level of hydraulic liquid in that cylinder, moving the float 47 from the solid line position shown in FIG. 1, through the broken line position to the top of the working cylinder. Consequently, the gas in the working cylinder is forced out of it and passes through the conduits 34' and 34 into the storage cylinder 5. When the float seats at the top of the cylinder, the pressure in the liquid supply line 38 continues to increase and, at a predetermined pressure such as about 2400 psi, actuates the pressure switch 14 which, in turn, actuates the relay 16 to change the position of valve 11. As shown in FIG. 3, liquid in the first working cylinder 2 then drains through the valve 11 back to the reservoir, lowering the float 47 from the solid line position shown in FIG. 3 to the bottom, broken line position.

While float 47 is falling, its working cylinder 2 is refilled with gas through conduit 32, and hydraulic liquid is supplied through the valve 11 and the inlet conduit 41 into the second working cylinder 3. As the level of hydraulic liquid in the second working cylinder raises, float 48 is lifted from the solid line position indicated in FIG. 3 through the broken line position to the top of the working cylinder; and gas in the second working cylinder is forced out of it, through the conduits 34'' and 34 into the storage cylinder 5. When the float 48 seals against the top of the second working cylinder 3, again the pressure of hydraulic liquid in the working cylinder supply line 38 increases above the predetermined pressure, actuating pressure switch 14 which, through the relay 16, causes valve 11 to move back to the position indicated in FIG. 1 for filling the first working cylinder with hydraulic liquid, while liquid is drained from the second working cylinder and the second working cylinder is refilled with gas through conduit 33.

The process continues with valve 11 alternating between the positions shown in FIGS. 1 and 3 until the volume of gas forced into the storage tank 5 is sufficient to increase the pressure in it above the predetermined pressure, such as about 2400 psi, which actuates pressure switch 18. Such pressure switch then actuates closing of the primary supply valve 19, at which time the system is fully charged with gas at the desired high pressure.

When it is desired to fill a portable tank 22, the inlet connection 21 of the tank is quick-coupled to the outlet connection 20 of the gas-compressing system. Gas flows from the storage tank 5 into the portable tank 22 through the check valve 8 until the pressure is equalized at a pressure determined by the respective volumes of the storage cylinder 5 and the portable tank 22. The gas-compressing system then can be switched to a "fast-fill" mode by changing the position of valve 10 from that shown in FIGS. 1 and 3 to the position shown in FIG. 4. This is accomplished by means of a manual switch 57 for the relay 15 controlling the position of valve 10.

With valve 10 in the position shown in FIG. 4, hydraulic liquid from pump 4 flows through the valve and the storage cylinder liquid supply conduit 44 into the storage cylinder. The level of liquid in the storage cylinder increases, lifting the float 49 from the solid line position shown in FIG. 4 and forcing gas from the storage cylinder into the portable tank 22. The pressure of gas in the portable tank is indicated by the pressure gauge 23.

Again depending on the respective volumes of the portable tank and the storage cylinder, the desired pressure of gas in the portable tank, such as about 2400 psi, may be reached before the storage tank is filled with hydraulic liquid. Pressure switch 13 is provided to sense the pressure of hydraulic liquid in the storage cylinder which is essentially the same as the pressure of the gas in the cylinder and the pressure of the gas in the portable tank. When the desired pressure is reached, pressure switch 13 actuates relay 15 to change the position of valve 10 back to the position shown in FIGS. 1 and 3.

On the other hand, if the portable tank is not charged to the desired pressure by forcing into it all of the gas in the storage cylinder, the storage cylinder float 49 will be lifted to the top of the cylinder and will seat against the upper gas inlet. In that case, pressure of hydraulic liquid in the storage tank continues to increase until the predetermined pressure is reached, whereupon, by means of pressure switch 13 and the relay 15, the position of valve 10 still is changed back to the position shown in FIGS. 1 and 3.

Preferably, an indicator light is provided to indicate when the gas-compressing system switches back from the "fast-fill" mode. Depending on the pressure of gas in the portable tank indicated by the pressureindicator 23, the portable tank can be disconnected or, if desired, it can remain connected to the gas-compressing system while the system alternates between the conditions shown in FIGS. 1 and 3 during which time both the storage tank and the portable tank will be charged to the predetermined pressure.

I claim:

1. In a gas-compressing system:

a first working cylinder;

a second working cylinder;

a gas-supplying component for introducing gas into said first working cylinder when the pressure of gas in said first working cylinder is below the pressure of the gas supplied by said gas-supplying component and including means for introducing gas into said second working cylinder when the pressure of gas in said second working cylinder is below the pressure of the gas supplied by the gas-supplying component;

liquid control means for alternately introducing liquid into said first working cylinder for forcing gas from it and draining liquid from said first working cylinder so as to cause said first working cylinder to be refilled with gas from said gas-supplying component, said liquid control means including means for introducing liquid into said second working cylinder for forcing gas from it as liquid is drained from said first working cylinder and for draining liquid from said second working cylinder as liquid is introduced into said first working cylinder;

means preventing backflow of gas from said first and second working cylinders to said gas-supplying component as gas is forced from said working cylinders;

a storage cylinder;

means directing the gas forced from said working cylinders into said storage cylinder; and means preventing backflow of gas from said storage cylinder to said working cylinders, whereby said storage cylinder alternately has gas forced into it from said first working cylinder and said second working cylinder.

2. In the system defined in claim 1, the liquid control means including means for sensing when liquid in the working cylinder has reached a predetermined level and for automatically draining liquid from the working cylinder when such level is reached.

3. In the system defined in claim 2, the working cylinder having an internal upright cavity including an upper portion and a bottom portion, a gas inlet communicating with said upper portion of said cavity through which gas is introduced by the gas-supplying component and valve means for closing said inlet when the level of liquid in the working cylinder is above the predetermined level such that further introduction of liquid into the working cylinder results in increasing the pressure of liquid in the working cylinder, the liquid control means including means sensing the pressure of liquid in the working cylinder and effecting draining of liquid from the working cylinder when the pressure of liquid in it increases to above a predetermined pressure.

4. In the gas-compressing system defined in claim 1, means sensing the pressure of gas in the storage cylinder for automatically cutting off the supply of gas from the gas-supplying component when the pressure of gas in the storage cylinder reaches a predetermined pressure.

5. In a system for compressing combustible fuel gas lighter than air:

a working cylinder;

a gas-supplying component for introducing gas into said working cylinder when the pressure of gas in said working cylinder is below the pressure of the gas supplied by said gas-supplying component, said gas-supplying component including an upright accumulator having an upper portion and a lower portion, means for introducing gas into said accumulator at low pressure, a moderate pressure compressor and means for supplying gas from said upper portion of said accumulator to said compressor;

liquid control means for alternately introducing liquid into said working cylinder for forcing gas from it and draining liquid from said working cylinder so as to cause said working cylinder to be refilled with gas from said gas-supplying component;

means preventing backflow of gas from said working cylinder to said gas-supplying component as gas is forced from said working cylinder;

a storage cylinder;

means directing the gas forced from said working cylinder into said storage cylinder; and means preventing backflow of gas from said storage cylinder to said working cylinder.

6. In the system defined in claim 5, an internal combustion engine driving the moderate pressure compressor and adapted to be driven by the combustible fuel gas and means supplying gas for driving said engine from the bottom portion of the accumulator.

7. In a gas-compressing system, a working cylinder, a gas-supplying component for introducing gas into said working cylinder when the pressure of gas in said working cylinder is below the pressure of the gas supplied by said gas-supplying component, liquid control means for alternately introducing liquid into said working cylinder for forcing gas from it and draining liquid from said working cylinder so as to cause said working cylinder to be refilled with gas from said gas-supplying component, means preventing backflow of gas from said working cylinder to said gas-supplying component as gas is forced from said working cylinder, a storage cylinder, means directing the gas forced from said working cylinder into said storage cylinder, means preventing backflow of gas from said storage cylinder to said working cylinder, a portable tank having an inlet connectible to said storage cylinder for receiving gas from said storage cylinder, and means for introducing liquid into said storage cylinder so as to force gas from said storage cylinder into said portable tank.

8. In the gas-compressing system defined in claim 7, means preventing backflow of gas from the portable tank to the storage cylinder, and means for automatically draining liquid from the storage cylinder when gas forced into the portable tank reaches a predetermined pressure.

9. In the gas-compressing system defined in claim 8, means for automatically recharging the storage cylinder with gas after the pressure of gas in the storage cylinder has been lowered by draining liquid from the storage cylinder.

10. In a gas-compressing system:

a first upright working cylinder;

a second upright working cylinder;

an upright storage cylinder having an internal volume substantially greater than the internal volume of the first working cylinder and the internal volume of the second working cylinder, each of said cylinders having a gas inlet in the upper portion thereof and a liquid inlet in the bottom portion thereof;

gas-supplying means for introducing gas into said first and second working cylinders;

check valve means preventing backflow of gas from either of said working cylinders to said gas-supplying means;

liquid-supplying means for pumping liquid, for directing such liquid into said first working cylinder to force the gas from it and, after said first working cylinder has been substantially filled with liquid, for directing such liquid into said second working cylinder to force the gas from it;

means for automatically draining liquid from said first working cylinder after it has been filled with liquid and from said second working cylinder after it has been filled with liquid;

means directing gas forced from said working cylinders into the storage cylinder; and means preventing backflow of gas from said storage cylinder to said working cylinders.

11. In the gas-compressing system defined in claim 10, an outlet conduit communicating with the storage cylinder, the liquid-supplying means including means for directing the liquid into the storage cylinder for forcing gas from the storage cylinder through said outlet conduit.

12. In a system for compressing a combustible gas, a working cylinder, a gas-supplying component for introducing such combustible gas into said working cylinder when the pressure of the gas in said working cylinder is below the pressure of the gas supplied by said gas-supplying component, a reservoir containing a supply of operating liquid, a pump for drawing liquid from said reservoir and for pressurizing such liquid, liquid control means for alternately introducing liquid under pressure from said pump into said working cylinder for forcing gas from it and draining liquid from said working cylinder so as to cause said working cylinder to be refilled with gas from said gas-supplying component, said liquid control means including means for returning liquid drained from said working cylinder to said reservoir, means preventing backflow of gas from said working cylinder to said gas-supplying component as gas is forced from said working cylinder, a storage cylinder, means directing the gas forced from said working cylinder into said storage cylinder, and means preventing backflow of gas from said storage cylinder to said working cylinder.

* * * * *